United States Patent [19]

Sollami

[11] Patent Number: 4,919,040

[45] Date of Patent: Apr. 24, 1990

[54] ROTOR VANE AND SHAFT ASSEMBLY

[76] Inventor: Phillip A. Sollami, 1300 E. Pine, Herrin, Ill. 62948

[21] Appl. No.: 283,505

[22] Filed: Dec. 12, 1988

[51] Int. Cl.[5] ..... F01C 9/00

[52] U.S. Cl. ..... 92/125; 92/121; 29/889.21; 416/213 R; 416/219 R

[58] Field of Search ..... 92/54, 106, 120, 121, 92/122, 125; 403/356, 358, 381, 375, 268, 267; 29/156.8 R; 416/213 R, 204 R, 219 R

[56] References Cited

U.S. PATENT DOCUMENTS

| | | | |
|---|---|---|---|
| 2,793,623 | 5/1957 | Ludwig et al. | 92/125 |
| 3,030,934 | 4/1962 | Herbst | 92/122 |
| 4,633,554 | 1/1987 | Clark et al. | 29/156.8 R |
| 4,823,678 | 4/1989 | Sollami | 92/121 |

FOREIGN PATENT DOCUMENTS

| | | | |
|---|---|---|---|
| 749684 | 5/1943 | Fed. Rep. of Germany | 29/156.8 R |
| 1196478 | 11/1959 | France | 92/120 |
| 1351481 | 12/1963 | France | 92/125 |
| 8905 | 1/1923 | Netherlands | 29/156.8 R |
| 285152 | 3/1972 | U.S.S.R. | 92/125 |
| 783550 | 9/1957 | United Kingdom | 29/156.8 R |

*Primary Examiner*—Robert E. Garrett
*Assistant Examiner*—Thomas Denion
*Attorney, Agent, or Firm*—Edmond T. Patnaude

[57] ABSTRACT

A rotor assembly includes a shaft and a planar vane extending in a radial direction from the shaft and having a peripheral groove receiving a resilient sealing gasket. The vane includes a tongue portion which depends into a radial cavity in the shaft and is sealably cemented thereto. Radially extending ribs on the ends of the tongue are accurately fitted against the ends of the cavity which are aligned with the adjacent ends of the bottom walls of the peripheral groove.

5 Claims, 2 Drawing Sheets

ROTOR VANE AND SHAFT ASSEMBLY

The present invention relates in general to the construction of a rotor for use in a rotary actuator or the like, and it relates in particular to a new and improved rotor shaft and vane assembly and to a method of making a rotor comprising a shaft and attached vane.

BACKGROUND OF THE INVENTION

Rotary actuators such as rotary motors and rotary pumps commonly utilize a rotor which includes a vane which extends radially from a shaft into a liquid-filled chamber into which a fixed stator vane or blade extends in a radial direction. In the case of a pump rotation of the rotor from an external drive forces liquid from the leading side of the rotor vane to the trailing side through an external conduit including a load. In the case of an actuator or motor, liquid is pumped into the chamber on one side of the rotor vane which thus imparts a torque to the rotor causing angular movement thereof. One such rotary actuator is described in detail in U.S. Pat. No. 4,495,856.

A major problem which is inherent with these types of devices is the leakage of the hydraulic fluid around the edges of the rotor vane from the high pressure side to the low pressure side of the chamber, and the most troublesome leakage area is at the corners of the vane where it adjoins the shaft and the associated housing. Extremely small dimensional tolerances must be maintained, and this has resulted in relatively high manufacturing costs.

SUMMARY OF THE INVENTION

Briefly, there is provided in accordance with the present invention a new and improved method of attaching a vane to a shaft and to a novel vane and shaft assembly for use in a rotary actuator or the like. In a preferred embodiment a generally planar vane or blade is provided with an elongated tongue which is coplanar with the vane and is fitted into a radial slot in the shaft. The vane is provided with a peripheral groove which is adapted to receive a generally U-shaped elastomeric sealing gasket to provide a seal between the vane and the adjacent surfaces of the housing. The tongue is provided with a plurality of raised ribs disposed on the sides and ends thereof and the slot has a depth which is slightly greater than the corresponding dimension of the tongue to provide a cavity in the shaft at the distal end of the tongue.

The dimensions of the vane and slot are chosen to provide a snug fit between the ends of the slot and the ribs located at the respective ends of the tongue to align the ends of the tongue with a pair of annular shoulders on the shaft and to provide an airtight seal between the shaft and the tongue along the entire lengths of the ribs. The outer end surfaces of the end ribs are aligned with the bottoms of the adjacent portions of the peripheral groove whereby leakage between the shaft and the end portions of the vanes is prevented by the associated sealing gasket. The cavity at the bottom of the tongue and the spaces on the sides and ends of the tongue are filled with an epoxy which bonds the vane to the shaft and prevents leakage of hydraulic fluid between the tongue and the shaft.

GENERAL DESCRIPTION OF THE DRAWINGS

The present invention will be better understood by a reading of the following detailed description taken in connection with the accompanying drawings wherein.

DETAILED DESCRIPTION OF A PREFERRED EMBODIMENT OF THE INVENTION

Figure 1:
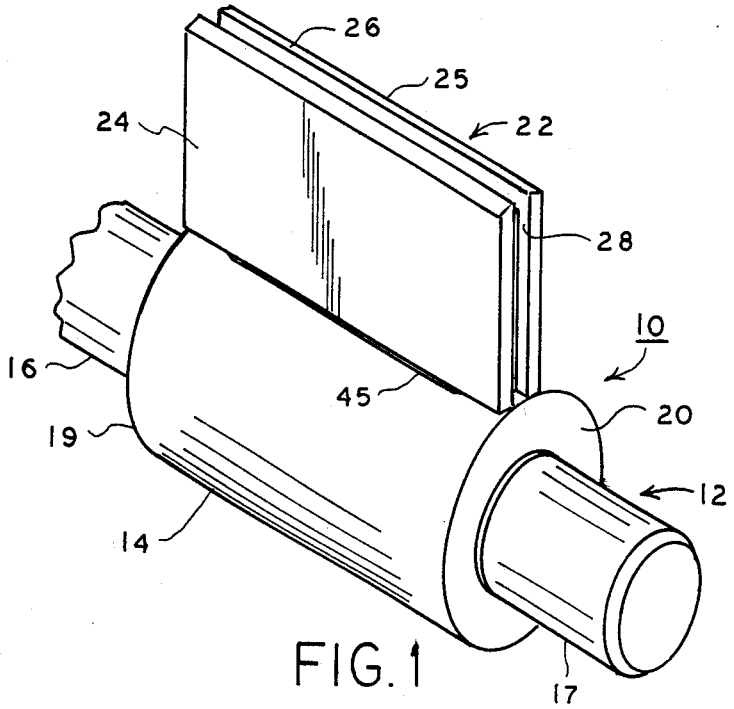
FIG. 1 is an isometric view of a rotor assembly embodying the present invention.
Figure 2:
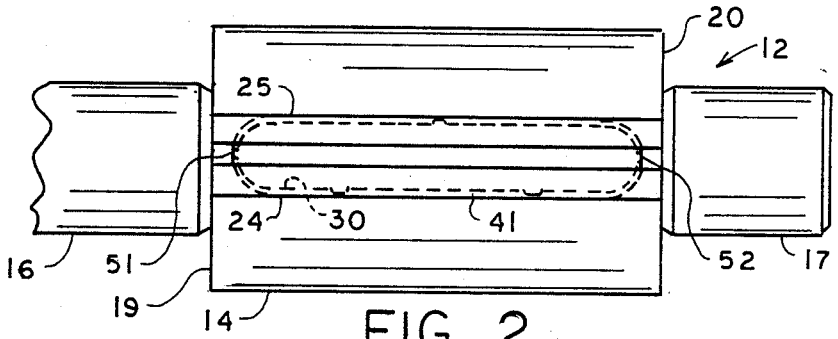
FIG. 2 is a plan view of the rotor shown in FIG. 1.

Referring particularly to FIG. 1, a rotor assembly 10 may be seen to include a shaft 12 having an intermediate cylindrical section 14 located between first and second end sections 16 and 17 of lesser diameter. Annular shoulders 19 and 20 are provided at the intersections of the end sections and the intermediate section.

Figure 4:
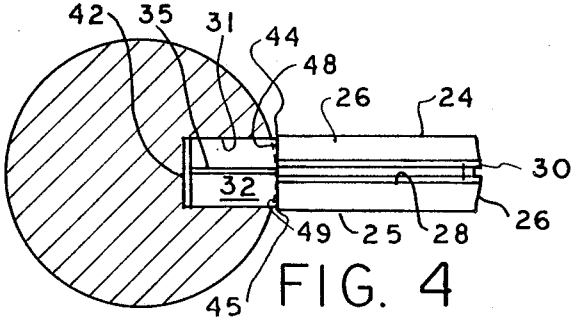
FIG. 4 is a partially cross-sectioned view of the rotor and vane assembly shown in FIGS. 1 and 2 with an elastomeric quad-seal assembled thereto.

A vane 22, which is generally rectangular in configuration, has opposite planar faces 24 and 25 separated by a generally U-shaped edge 26 in which a peripheral groove 28 is provided. The groove 28 is rectangular in cross-section and is adapted to receive a U-shaped elastomeric gasket 30 as shown in FIG. 4. As may be seen in FIG. 4, the gasket 30 extends outwardly beyond the adjacent marginal edges 26 of the vane and the two ends of the gasket 30 abut the adjacent surfaces of the shaft and are compressed against it when the rotor assembly is operatively mounted in an associated housing (not shown).

Figure 3:
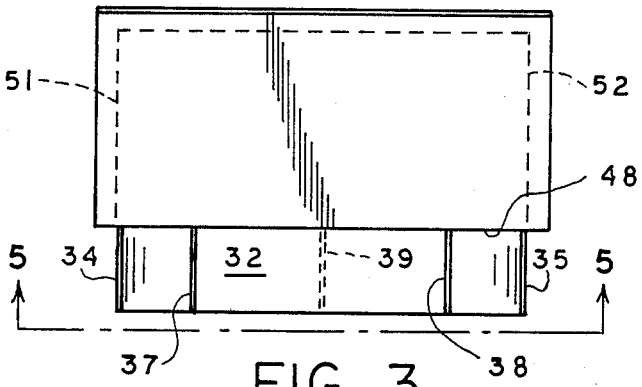
FIG. 3 is an elevational view of the vane part of the rotor assembly shown in FIGS. 1 and 2.
Figure 5:
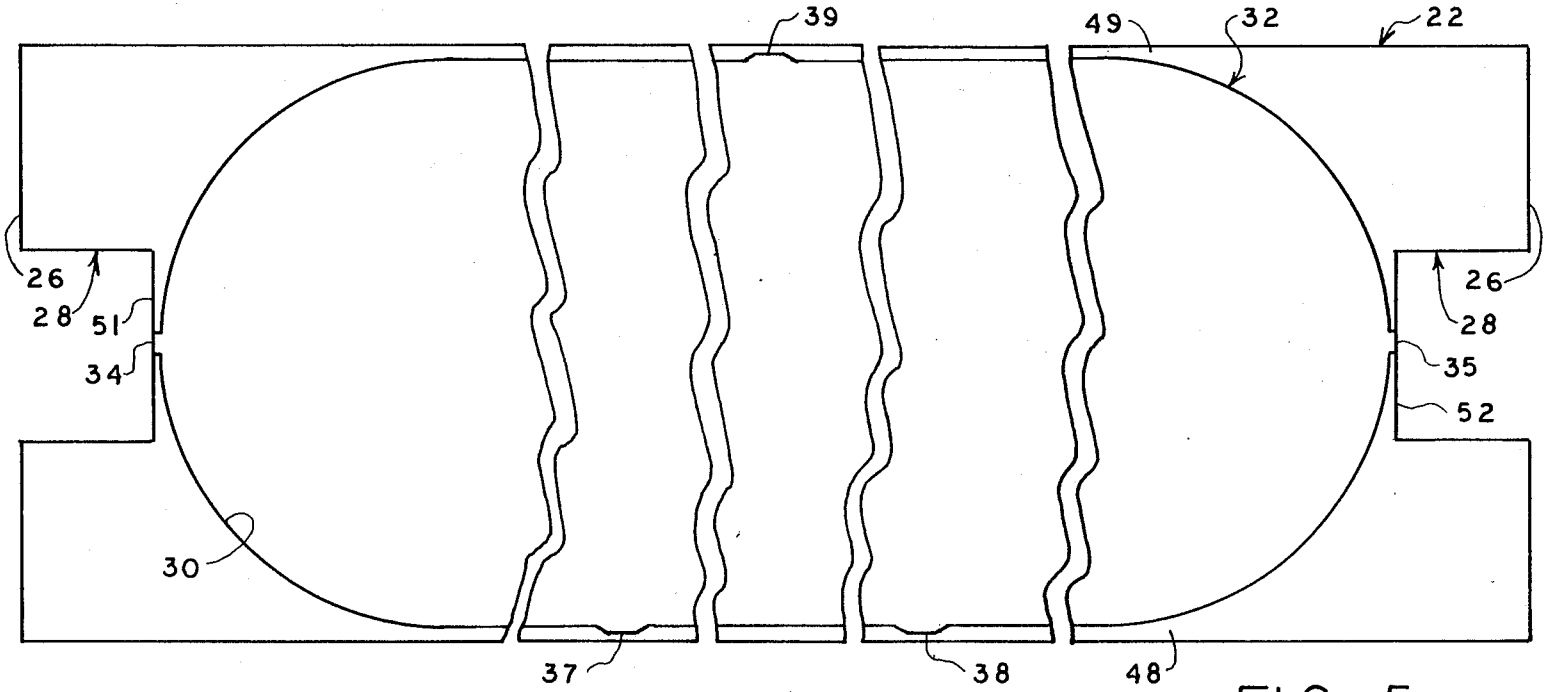
FIG. 5 is a bottom view of the vane taken from the line 5—5 in FIG. 3.

The intermediate section 14 of the shaft is provided with a longitudinally elongate cavity 31 which is arcuate at its two ends and which extends in a radial direction toward the center of the shaft as best shown in FIG. 4. A tongue 32 is an integral part of the vane 22 and has a side wall which is generally complimentary to the side wall of the cavity 31, but somewhat smaller to provide a space in the cavity which surrounds the tongue. A plurality of rectilinear ribs 34 and 35 are provided at the respective ends of the tongue as best shown in FIG. 3, and a second plurality of rectilinear ribs 37, 38 and 39 are provided on the sides of the tongue.

With the tongue 32 in place in the cavity 31 the end ribs 34 and 35 fit snugly against the end walls of the cavity while an accurate close fit is provided along the sides of the tongue. An imperforate bonding material such as an epoxy 41 fills the remainder of the cavity including the space 42 between the bottom of the cavity and the adjacent end of the tongue 32. The bonding material 41 also fills the generally triangular spaces 44 and 45 located between the shaft 12 and the shoulders 48 and 49 at the juncture of the tongue and body portions of the vane 32 shown in FIG. 4. It will also be seen that the outer edges of the end ribs 34 and 35 are respectively aligned with the bases or bottom surfaces 51 and 52 of the peripheral groove 28 in the vane 22. As a consequence, an airtight seal is provided between the tongue and the shaft and the gasket 30 provides a seal between the shaft and the portions of the vane which extend longitudinally beyond the ends of the tongue.

It is important that the ends of the vane 22 be aligned with the annular shoulders 19 and 20 and such alignment is assured by virtue of the snug fit between the end ribs 34 and 35 and the ends of the cavity 31.

While the present invention has been described in connection with a particular embodiment thereof, it will be understood by those skilled in the art that many changes and modifications may be made without departing from the true spirit and scope of the present invention. Therefore, it is intended by the appended claims to cover all such changes and modifications which come within the true spirit and scope of the present invention.

What is claimed:

1. A rotor, comprising in combination a shaft having a longitudinally elongate radial cavity therein, a vane having oppositely disposed planar faces and a peripheral groove disposed in the edges of said vane between said faces for receiving an elastomeric sealing member, said vane including an integral tongue depending into said cavity with said vane extending in a radial direction from said shaft with the central longitudinal axis of said shaft lying in the plane of said vane, said tongue including a plurality of ribs tightly fitted against said shaft at the ends of said cavity, and an imperforate bonding material filling the space between said tongue and the surfaces of said shaft defining said cavity to bond said vane to said shaft and to prevent the passage of fluid between said tongue and shaft.

2. A rotor according to claim 1 comprising an elastomeric sealing member disposed in said groove and extending outwardly beyond the surfaces of said vane adjacent said groove, and said sealing member having ends respectively compressed against said shaft at the ends of said cavity.

3. A rotor according to claim 2, wherein said vane has first and second side edges extending in a radial direction relative to said shaft, the grooves in said side edges having respective base portions aligned with the outer surfaces of said plurality of ribs.

4. A rotor according to claim 2 comprising a second plurality of ribs provided on the side surface of said tongue.

5. A rotor according to claim 3 wherein said shaft has a cylindrical intermediate portion in which said elongate cavity is disposed and two end portions separated by said intermediate portion, said end portions having diameters less that the diameter of said intermediate portion to provide annular shoulders at the intersections of said end portions and said intermediate portion, and said side edges of said vane lying in the respective planes of said annular shoulders.

* * * * *